US006232573B1

(12) United States Patent
Fukai et al.

(10) Patent No.: US 6,232,573 B1
(45) Date of Patent: May 15, 2001

(54) TITANIUM ALLOY SHEET AND PRODUCTION METHOD THEREOF

(75) Inventors: Hideaki Fukai; Hiroshi Iizumi, both of Fukuyama (JP)

(73) Assignee: NKK Corporation, Tokyo (JP)

( * ) Notice: Subject to any disclaimer, the term of this patent is extended or adjusted under 35 U.S.C. 154(b) by 0 days.

(21) Appl. No.: 09/207,826

(22) Filed: Dec. 9, 1998

(30) Foreign Application Priority Data

Dec. 24, 1997 (JP) ..... 9-366067

(51) Int. Cl.[7] ..... C22C 14/00

(52) U.S. Cl. ..... 219/121.14; 219/121.35; 228/235.2

(58) Field of Search ..... 228/193, 194, 228/235.2; 219/121.14, 121.35

(56) References Cited

U.S. PATENT DOCUMENTS 3,579,800 * 5/1971 Packard ..... 29/423
3,711,937 * 1/1973 Emley ..... 228/206
3,798,747 * 3/1974 Lalwaney ..... 72/364
4,406,761 * 9/1983 Shimogori et al. ..... 205/709
4,826,605 * 5/1989 Doble et al. ..... 210/721
5,060,845 * 10/1991 Suenaga et al. ..... 228/186
5,415,336 * 5/1995 Stenard et al. ..... 228/193
5,513,791 * 5/1996 Rowe et al. ..... 228/118

FOREIGN PATENT DOCUMENTS

402192804 * 7/1990 (JP) ..... 228/235.2

* cited by examiner

*Primary Examiner*—Samuel M. Heinrich
(74) *Attorney, Agent, or Firm*—Frishauf, Holtz, Goodman, Langer & Chick, P.C.

(57) ABSTRACT

A titanium alloy sheet having a surface roughness satisfying the relationship Ra≦2 μm in all directions and a surface waviness satisfying the relationship $W_{CA}$≦10 μm shows excellent workability because of the small anisotropy with respect to mechanical properties such as bending properties, and also excellent appearance after it is formed into a component. Such surface conditions of titanium alloy sheet can be obtained by acid pickling or grinding and acid pickling after rolling. Pack rolling, especially in which a titanium alloy slab is packed with carbon steels in vacuum by electron beam welding method and then rolled, is preferable. Application of cross rolling to the rolling makes it possible to obtain smaller anisotropy with respect to mechanical properties.

20 Claims, No Drawings

TITANIUM ALLOY SHEET AND PRODUCTION METHOD THEREOF

BACKGROUND OF THE INVENTION

1. Field of the Invention

The present invention relates to a titanium alloy sheet which has excellent workability and small anisotropy with respect to mechanical properties such as bending properties and a production method thereof.

2. Description of Related Art

Generally, a titanium alloy sheet is produced as a coil by hot rolling that uses a tandem mill, and such a coil is cut to a predetermined length for sheet forming. With respect to titanium alloys that have relatively poor workability such as α+β type titanium alloys, a so-called "pack rolling" is performed, mainly using a reverse mill, in which a titanium alloy slab is packed with carbon steels, for example, by covering the upper and down sides of a slab with carbon steels or by inserting a slab in a carbon steel box before rolling, so that a decrease in temperature during rolling is suppressed and rolling is performed in a high temperature range where the titanium alloy has relatively good workability.

In any one of the methods described above, hot rolling is performed in the air, and then, oxide scales which are formed on surfaces during heating or rolling and oxygen-enriched layers underneath are removed in a grinding process, for example, using a coil grinder or a sheet grinder.

It is an essential step for improving the quality of a titanium alloy sheet to remove oxide scales on surfaces and oxygen-enriched layers underneath. The reason is that, if oxide scales and oxygen-enriched layers remain, the appearance of a product deteriorates, and since the areas near the surfaces are significantly hardened by the oxide scales and the oxygen-enriched layers, the workability such as bending properties' deteriorates.

The workability, such as bending properties, is sensitively influenced by surface conditions such as surface roughness, and thus, in a grinding process, a grindstone, an abrasive belt and abrasive grains are appropriately combined in order to control the surface roughness of the finish.

However, since grinding is performed in one direction, there is a difference in surface conditions such as surface roughness between the grinding direction and a direction transversal to it. Thereby, the workability is good in the grinding direction, however, significantly bad in the direction transversal to the grinding direction, resulting in a large anisotropy with respect to mechanical properties.

In actually forming a titanium alloy sheet into a certain component, a step of bending or the like is performed, and the bending direction is not limited to the grinding direction. The bending may be performed in any direction, for example, in the direction transversal or diagonal to the grinding direction. Although excellent workability is desired in all directions of a sheet plane, the current titanium alloy sheet which is ground in one direction cannot meet this requirement.

SUMMARY OF THE INVENTION

It is accordingly an object of the present invention to provide a titanium alloy sheet which has excellent workability, small anisotropy with respect to mechanical properties such as bending properties, and also excellent appearance after it is formed into a component, and a production method thereof.

According to the present invention, there is provided a titanium alloy sheet having a surface roughness that satisfies the relationship $Ra \leqq 2\ \mu m$ in all directions and a surface waviness that satisfies the relationship $W_{CA} \leqq 10\ \mu m$.

This titanium alloy sheet can be produced by a method which comprises the steps of rolling a titanium alloy slab, and then acid pickling the rolled titanium alloy sheet, for example, with 1 to 10% HF and 1 to 40% $HNO_3$, whereby a surface roughness satisfying the relationship $Ra \leqq 2\ \mu m$ in all directions and a surface waviness satisfying the relationship $W_{CA} \leqq 10\ \mu m$ are achieved.

The method can further comprise a step of grinding the rolled titanium alloy sheet before acid pickling.

In the method, rolling may be replaced by pack rolling, preferably by packing a titanium alloy slab with carbon steels in a vacuum by an electron beam welding method and then rolling it. Here, the titanium alloy slab signifies not only its as-cast slab, but also its rolled semi-product having a certain thickness.

When cross rolling, for example, with a cross ratio 0.2 to 5 is applied to rolling, it is more effective to obtain the surface conditions described above.

DETAILED DESCRIPTION OF THE INVENTION

A titanium alloy sheet in accordance with the present invention has a surface roughness that satisfies the relationship $Ra \leqq 2\ \mu m$ in all directions and has a surface waviness that satisfies the relationship $W_{CA} \leqq 10\ \mu m$. By setting the surface roughness of the sheet at $Ra \leqq 2\ \mu m$ in all directions, the sheet exhibits excellent workability even when forming such as bending is performed in any direction. Also, when a sheet with the surface waviness at $W_{CA} \leqq 10\ \mu m$ is formed into a component, a rough surface appearing at forming can be suppressed.

In such a case, by performing acid pickling as surface finishing after rolling, a titanium alloy sheet having low surface roughness, small anisotropy, and low a surface waviness can be produced.

Also, by performing grinding and acid pickling as surface finishing after rolling, such surface conditions can be easily obtained, because the surface roughness of the sheet is reduced by grinding before acid pickling.

A titanium alloy slab may be packed with carbon steels before rolling in the air to maintain a high rolling temperature, more preferably packed in a vacuum by an electron beam welding method to suppress the deposition of oxide scales and the formation of oxygen-enriched layers during heating. Therefore, the surface finishing treatment can be simplified, and also the titanium alloy sheet having a surface roughness that satisfies $Ra \leqq 2\ \mu m$ in all directions and a surface waviness that satisfies $W_{CA} \leqq 10\ \mu m$ can be more easily obtained.

Cross rolling is preferably applied to rolling. By cross rolling, anisotropy with respect to mechanical properties resulting from the texture formation during rolling can be significantly suppressed. By performing acid pickling, or grinding and acid pickling, as subsequent surface treatment, the surface roughness can be more easily and securely set at $Ra \leqq 2\ \mu m$ in all directions, and the surface waviness can be set at $W_{CA} \leqq 10\ \mu m$. The cross ratio at cross rolling should be set at 0.2~5 to obtain much smaller anisotropy with respect to mechanical properties.

Mixed acid of 1~10% HF+1~40% $HNO_3$ should be preferably used for the acid pickling described above, because this mixed acid enables oxide scales to be removed without absorption of much hydrogen into a titanium alloy sheet.

EXAMPLE 1

Titanium alloy slabs, having a thickness of 150 mm, of α+β type AMS4899 (Ti—4.5% Al—3% V—2% Mo—2%

Fe alloy) and AMS4907D (Ti—6% Al—4% V alloy) were used as starting materials.

One slab of AMS4899 was heated at 840° C., and then rolled to a sheet having a thickness of 3 mm, using a tandem mill.

The other slabs of AMS4899 were heated at 840° C. and rolled to semi-products having a thickness of 20 mm. Then, some semi-products were covered with carbon steels on the upper and down sides in the air, and the other slabs were inserted in carbon steel boxes and welded in a vacuum by an electron beam method. Finally, the semi-products packed with carbon steels in this way were heated at 820° C. and rolled to sheets having a thickness of 3 mm, using a reverse mill, in which cross rolling was performed with a cross ratio of 1. The slabs of AMS4907D were rolled to sheets having a thickness of 3 mm in the same pack rolling method as in the case of the slabs of AMS4899 described above except that the heating temperature was set at 950° C. in place of 840° C. and 820° C.

Annealing was performed at 720° C. for all the sheets, and surface finishing was performed by grinding with a coil grinder or a sheet grinder with an abrasive #60 and an abrasive #180, or by acid pickling with 3% HF+10% $HNO_3$ for 10 minutes, or by a combination of the grinding and the acid pickling described above. The grinding direction was one way and the same as the rolling direction. Shot blasting was conducted on a sheet before acid pickling as a reference.

All the production conditions described above are summarized in Table 1.

TABLE 1

| Sheet | Alloy | Rolling Mill | Rolling method | Surface Finishing |
|---|---|---|---|---|
| 1 | AMS4899 | Tandem | Normal Rolling | Coil Grinding |
| 2 | AMS4899 | Reverse | Pack Rolling | Sheet Grinding |
| 3 | AMS4907D | | (packed in the | |
| 4 | AMS4899 | | air) | Shot Blasting + |
| 5 | AMS4907D | | | Acid Pickling |
| 6 | AMS4899 | | | Sheet Grinding + |
| 7 | AMS4907D | | | Acid Pickling |
| 8 | AMS4899 | | Pack Rolling | Sheet Grinding |
| 9 | AMS4907D | | (pack in | |
| 10 | AMS4899 | | vacuum) | Acid Pickling |
| 11 | AM54907D | | | |
| 12 | AMS4899 | | | Sheet Grinding + Acid Pickling |

After surface finishing, the sheets were subject to the measurement of surface roughness Ra and surface waviness $W_{CA}$. Also, the critical bending radius was measured by conducting a bending test, and the surface appearance at bending med at a bending radius R of 15 mm was investigated.

The results are shown in Table 2.

Even though the sheet 1 was ground with an abrasive #60 and an abrasive #180, because of the one-way only grinding, the surface roughness Ra in the direction transversal to the grinding direction is large in comparison with that in the grinding direction, resulting in a large anisotropy with respect to critical bending radius. However, the sheet 1 has a small surface waviness $W_{CA}$, and therefore a good appearance is obtained after bending.

The sheets 2, 3, 8 and 9 show the same tendency as the sheet 1 because of the one-way only grinding, even though they were subject to pack rolling by cross rolling.

In the case of shot blasting+acid pickling, as shown in the sheets 4 and 5, the surface waviness $W_{CA}$ is very large, resulting in a bad appearance after bending, although satisfactory surface roughness Ra is obtained. Shot blasting cannot be applicable to thin sheets as in the present case.

In the case of the sheets 6, 7 and 12 produced by the present invention method, grinding+acid pickling significantly reduces not only surface roughness Ra, but also surface waviness $W_{CA}$, resulting in a small anisotropy with respect to bending properties and a good appearance after bending.

As shown in the sheets 10 and 12, when packing was performed in a vacuum, a small anisotropy with respect to critical bending radius and a good appearance after bending are obtained only by acid pickling for 10 minutes. This is because only small amount of oxides scales were formed due to the packing in a vacuum, and then completely removed by short-time acid pickling treatment as in this case.

TABLE 2

| | Ra (μm) | | | $W_{CA}$ (μm) | | Critical Bending Radius (t) | | | |
|---|---|---|---|---|---|---|---|---|---|
| Sheet | L | T | D | L | T | L | T | Appearance | N.B. |
| 1 | 1.0 | 2.1 | 1.6 | 5.4 | 5.6 | 2 | 4 | good | comparison |
| 2 | 1.1 | 2.2 | 1.6 | 5.6 | 5.8 | 2 | 4 | good | comparison |
| 3 | 1.4 | 2.5 | 1.8 | 6.1 | 6.2 | 4 | 6 | good | comparison |
| 4 | 1.4 | 1.7 | 1.5 | 14.3 | 15.6 | 2 | 2 | bad | comparison |
| 5 | 1.5 | 1.9 | 1.7 | 15.4 | 16.7 | 4 | 4 | bad | comparison |
| 6 | 0.7 | 1.2 | 1.0 | 6.3 | 6.4 | 2 | 2 | good | invention |
| 7 | 0.9 | 1.4 | 1.1 | 8.1 | 8.8 | 4 | 4 | good | invention |
| 8 | 1.0 | 2.2 | 1.7 | 5.5 | 5.9 | 2 | 4 | good | comparison |
| 9 | 1.1 | 2.6 | 1.9 | 5.9 | 6.2 | 4 | 6 | good | comparison |
| 10 | 0.9 | 0.9 | 1.0 | 8.7 | 9.0 | 2 | 2 | good | invention |
| 11 | 1.0 | 1.1 | 1.0 | 8.8 | 9.0 | 4 | 4 | good | invention |
| 12 | 0.9 | 0.9 | 0.9 | 7.9 | 7.7 | 2 | 2 | good | invention |

L: Grinding Direction,
T: Direction Transversal to Grinding Direction
D: Direction Diagonal to Grinding Direction,
(t): Sheet Thickness

EXAMPLE 2

Titanium alloy slabs, having a thickness of 150 mm, of α+β AMS4899 (Ti—4.5% Al—3% V—2% Mo—2% Fe alloy) was used starting materials.

The slabs were heated at 840% and rolled to semi-products having a thickness of 20 mm. Then, all the semi-products were inserted in carbon steel boxes and welded in a vacuum by an electron beam method. The semi-products packed with carbon steels in this way were heated at 820° C. and rolled to sheets having a thickness of 3 mm, using a reverse mill, in which cross rolling was performed with various cross ratios of 0.2 to 5.0.

After annealing at 720° C., and the sheets were subject to the surface finishing by grinding with a sheet grinder with an abrasive #60 and an abrasive #180, followed by acid pickling with 3% HF+10% $HNO_3$ for 10 minutes.

And, tensile properties were measured since no difference of bending properties between the sheets was recognized.

The results are shown in Table 3.

The preferable cross rolling with cross ratios of 0.2~5.0 in the present invention enables the production of a sheet which has a small difference of tensile properties between the grinding direction and the direction transversal to the grinding direction.

TABLE 3

| | L | | | T | | |
|---|---|---|---|---|---|---|
| Cross Ratio | 0.2 PS(MPa) | UTS (MPa) | EI(%) | 0.2 PS(MPa) | UTS(MPa) | EI(%) |
| 0.2 | 969 | 1029 | 11.1 | 901 | 970 | 17.4 |
| 1.0 | 934 | 1004 | 16.4 | 929 | 1000 | 16.3 |
| 5.0 | 903 | 969 | 17.0 | 970 | 1030 | 12.4 |

L:Grinding Direction, T:Diection Tranversal to Grinding Direction 0.2%
PS: Proof Stress at 0.2% Strain
UTS: Ultimate Tensile Strength
EL: Elongation

EXAMPLE 3

Titanium alloy slabs, having a thickness of 150 mm, of α+β type AMS4899 (Ti—4.5% Al—3% V—2% Mo—2% Fe alloy) was used as starting materials.

The slabs were heated at 840° C. and rolled to semi-products having a thickness of 20 mm. Then, all the semi-products were inserted in carbon steel boxes and welded in a vacuum by an electron beam method. The semi-products packed with carbon steels in this way were heated at 820° C. and rolled to sheets having a thickness of 3 mm, using a reverse mill, in which cross rolling was performed with a cross ratio of 1.0.

After annealing at 720° C., and the sheets were subject to the surface finishing by grinding with a sheet grinder with an abrasive #60 and an abrasive #180, followed by acid pickling with various concentrations of HF and $HNO_3$ for 10 minutes.

And, surface appearance was observed, and hydrogen absorption content was measured.

The results are shown in Table 4.

When acid pickling is performed within the desirable acid concentration ranges of the present invention, very good surface appearance and little hydrogen absorption can be achieved.

TABLE 4

| Concentration(%) | | | Hydrogen Absorption |
|---|---|---|---|
| HF | $HNO_3$ | Appearance | (ppm) |
| 1.0 | 10.0 | very good | 24 |
| 3.0 | 1.0 | very good | 19 |
| 3.0 | 10.0 | very good | 11 |
| 3.0 | 40.0 | very good | 6 |
| 10.0 | 10.0 | very good | 31 |

What is claimed:

1. A method for producing a titanium alloy sheet, comprising:

(a) packing a titanium alloy slab with carbon steel by electron beam welding in a vacuum;

(b) rolling the titanium alloy slab packed with carbon steel from step (a); and (c) acid pickling the rolled titanium alloy sheet from step (b), whereby a titanium alloy sheet having a surface roughness satisfying the relationship $Ra \leqq 2$ μm in all directions and a surface waviness satisfying the relationship $W_{CA} \leqq 10$ μm is obtained.

2. The method according to claim 1, wherein the rolling is performed by cross rolling.

3. The method according to claim 1, wherein the rolling is performed by cross rolling with a cross ratio of 0.2 to 5.

4. The method according to claim 5, wherein the acid pickling is performed with 1 to 10% HF and 1 to 40% $HNO_3$.

5. The method according to claim 3, wherein the acid pickling is performed with 1 to 10% HF and 1 to 40% $HNO_3$.

6. The method according to claim 1, wherein the titanium alloy slab has a composition comprising 4.5 wt. % Al, 3 wt. % V, 2 wt. % Mo, 2 wt. % Fe with the remainder being Ti.

7. The method according to claim 1, wherein the titanium alloy slab has a composition comprising 6 wt. % Al, 4 wt. % V with the remainder being Ti.

8. The method according to claim 1, wherein the rolling is carried out by cross rolling with a cross ratio of 1 and the acid pickling is carried with 3% HF and 10% $HNO_3$ for 10 minutes.

9. The method according to claim 1, wherein the acid pickling is carried out with HF having a concentration selected from the group consisting of 1.0%, 3.0% and 10.0%; and $HNO_3$ having a concentration selected from the group consisting of 1.0%, 10% and 40%.

10. A method for producing a titanium alloy sheet comprising:

a) packing a titanium alloy slab with carbon steel by electron beam welding in a vacuum;

(b) rolling the titanium alloy slab packed with carbon steel from step (a);

(c) grinding the packed rolled titanium alloy sheet from step (b); and (d) acid pickling the ground titanium alloy sheet from step (c), whereby a titanium alloy sheet having a surface roughness satisfying the relationship $Ra \leqq 2$ μm in all directions and a surface waviness satisfying the relationship $W_{CA} \leqq 10$ μm is obtained.

11. The method according to claim 10, wherein the rolling is performed by cross rolling.

12. The method according to claim 10, wherein the rolling is performed by cross rolling with a cross ratio of 0.2 to 5.

13. The method according to claim 10, wherein the acid pickling is performed with 1 to 10% HF and 1 to 40% $HNO_3$.

14. The method according to claim 6, wherein the acid pickling is performed with 1 to 10% HF and 1 to 40% $HNO_3$.

15. The method according to claim 11, wherein the acid pickling is performed with 1 to 10% HF and 1 to 40% $HNO_3$.

16. The method according to claim 12, wherein the acid pickling is performed with 1 to 10% HF and 1 to 40% $HNO_3$.

17. The method according to claim 10, wherein the titanium alloy slab has a composition comprising 4.5 wt. % Al, 3 wt. % V, 2 wt. % Mo, 2 wt. % Fe with the remainder being Ti.

18. The method according to claim 10, wherein the titanium alloy slab has a composition comprising 6 wt. % Al, 4 wt. % V with the remainder being Ti.

19. The method according to claim 10, wherein the rolling is carried out by cross rolling with a cross ratio of 1 and the acid pickling is carried with 3% HF and 10% $HNO_3$ for 10 minutes.

20. The method according to claim 10, wherein the acid pickling is carried out with HF having a concentration selected from the group consisting of 1.0%, 3.0% and 10.0%; and $HNO_3$ having a concentration selected from the group consisting of 1.0%, 10% and 40%.

* * * * *